US008322629B2

(12) United States Patent
Fleig

(10) Patent No.: US 8,322,629 B2
(45) Date of Patent: Dec. 4, 2012

(54) ELECTRICAL BRIDGE IN FUEL INJECTORS

(75) Inventor: Michael Fleig, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 85 days.

(21) Appl. No.: 11/718,735

(22) PCT Filed: Oct. 31, 2005

(86) PCT No.: PCT/EP2005/055652

§ 371 (c)(1),
(2), (4) Date: May 7, 2007

(87) PCT Pub. No.: WO2006/056520

PCT Pub. Date: Jun. 1, 2006

(65) Prior Publication Data

US 2008/0185461 A1 Aug. 7, 2008

(30) Foreign Application Priority Data

Nov. 24, 2004 (DE) ..... 10 2004 056 667

(51) Int. Cl.

| | |
|---|---|
| ***F02D 1/06*** | (2006.01) |
| ***F02D 7/00*** | (2006.01) |
| ***B05B 1/30*** | (2006.01) |
| ***F02M 51/00*** | (2006.01) |

(52) U.S. Cl. ..... 239/5; 239/584; 239/585.1; 239/585.2; 123/472; 123/478

(58) Field of Classification Search ..... 239/88, 239/569, 583, 584, 585.1, 585.2, 585.3, 585.4, 239/585.5; 123/472, 476, 478, 494; 29/890.124; 439/395, 439, 443

See application file for complete search history.

(56) References Cited

U.S. PATENT DOCUMENTS

| | | | | |
|---|---|---|---|---|
| 4,033,513 | A * | 7/1977 | Long | 239/585.3 |
| 4,434,765 | A * | 3/1984 | Eshelman | 123/472 |
| 4,725,041 | A * | 2/1988 | Chauvin et al. | 251/129.15 |
| 4,950,171 | A * | 8/1990 | Muzslay | 439/76.1 |
| 6,565,020 | B1 * | 5/2003 | Fischer et al. | 239/585.1 |

* cited by examiner

*Primary Examiner* — Len Tran
*Assistant Examiner* — Ryan Reis
(74) *Attorney, Agent, or Firm* — Michael Best & Friedrich LLP

(57) ABSTRACT

Disclosed is a fuel injector in which at least one electrically triggered valve is disposed inside an injector member and is connected to an externally accessible injector member contact by means of a solid conductor, the solid conductor and the electrical valve contact being interconnected directly via an electrically conducting positive connection or indirectly via an electrically conducting connecting element. The solid conductor is configured so as to substantially maintain the shape thereof under the influence of the proper weight thereof.

12 Claims, 5 Drawing Sheets

ELECTRICAL BRIDGE IN FUEL INJECTORS

CROSS-REFERENCE TO RELATED APPLICATION

This application is a 35 USC 371 application of PCT/EP 2005/055652 filed on Oct. 31, 2005.

BACKGROUND OF THE INVENTION

1. Field of the Invention

In fuel injection systems for direct-injection internal combustion engines, fuel injectors that contain one or more electrically triggerable valves are employed. For instance, an electrically triggerable magnet valve or piezoelectric valve may be provided for controlling a needle valve and thus for controlling the course of injection. Further valves may be used, for instance for a pressure boost. Separately testing the functionality of the various valves and the components connected to these valves or controlled by these valves, however, is often a challenge. The electrical contacting of these valves is also often a challenge.

2. Prior Art

Since the electrically triggerable valve or valves are typically accommodated in the interior of an injector body, the electrical contacting of these electrically triggerable valves presents considerable technical difficulties. In many cases, on top of the injector body there is an electrical contact that can be connected to a corresponding control system and power supply system located outside the injector body. Via this contact (which may be either a multiple plug, or a plurality of individual plugs), all the electrically triggerable valves received in the interior of the injector body are as a rule triggered. In the interior of the injector body, this electrical contact must be connected to corresponding contacts of the electrically triggerable valve or valves of the injection system. This connection is typically done by means of flexible electrical cables and a simple soldering process.

This method for electrically contacting the electrically triggerable valves is associated with various disadvantages, however. For instance, the method is technically quite labor-intensive, since typically the cables must be initially soldered by hand against the corresponding electrical contacts. In practice, this method step requires great effort and is very time-consuming. Moreover, the connection between the electrically triggerable valves and the electrical contact on the injector body can be undone again only with difficulty. For removing or disassembling the injector body, the soldered connections must typically be unsoldered again. Such a labor-intensive process makes it uneconomical to repair the injectors or replace individual parts of the injector body.

SUMMARY AND ADVANTAGES OF THE INVENTION

According to the invention, a fuel injector for injecting fuel into a combustion chamber of an internal combustion engine is therefore proposed which avoid the described disadvantages of the prior art. The fuel injector has an injector body contact, at least one electrically triggerable valve let into the injector body, and at least one electrical injector body contact accessible from outside the injector body. At least one of the electrically triggerable valves should have at least one electrical valve body contact. A fundamental concept of the present invention is to use a solid conductor for the electrical connection between the at least one valve contact and the at least one injector body contact, which solid conductor, in contrast to a simple cable or wire, does not become deformed under its own weight and is contactable via plug contacts, for instance, instead of a soldered connection. Slight plastic deformation of the solid conductor under its own weight and under additional exertion of force can be tolerated, if the design of the solid conductor remains substantially unchanged. The at least one solid conductor thus represents a kind of artificial lengthening of the electrical valve contacts.

The at least one solid conductor and the at least one electrical valve contact are connected via an electrically conductive connection and/or via at least one electrically conductive connecting element. In the latter case, the at least one connecting element is connected to the at least one solid conductor and the at least one electrical valve contact via a respective electrically conductive connection.

With the concept of the invention, it is possible particularly in a simple way to attain fuel injectors which can be disassembled into a plurality of individual parts and reassembled without being destroyed. The injector body contact and the at least one electrically triggerable valve can be disposed in different individual parts, and the at least one solid conductor is reversibly connected to at least one injector body contact. This connection can be made in particular via a plug connection. On one end, for instance, the solid conductor is connected solidly or in a way in which it can be undone only with difficulty to a valve contact, and on the other end it is connected detachably to an injector body contact. Along the way from the valve contact to the injector body contact, the solid conductor may extend through further individual parts of the injector body, particularly through one or more conductor conduits. The solid conductor can then be electrically insulated from the injector body by means of a shrink-fit hose, for instance.

The fuel injector described makes a greatly simplified production process possible, compared to the prior art. First, the individual parts described are produced individually and tested. Next, the at least one valve contact is joined solidly or in a way that can be undone only with difficulty to a solid conductor. Then the individual parts are joined together to make a single injector body, and the at least one solid conductor is connected reversibly to the at least one injector body contact.

BRIEF DESCRIPTION OF THE DRAWINGS

The invention is described in further detail below in terms of the exemplary embodiments shown in the drawings. Identical reference numerals designate components that are the same as one another or correspond to one another in their function. Individually, the drawings show.

DESCRIPTION OF THE PREFERRED EMBODIMENTS

Figure 1:
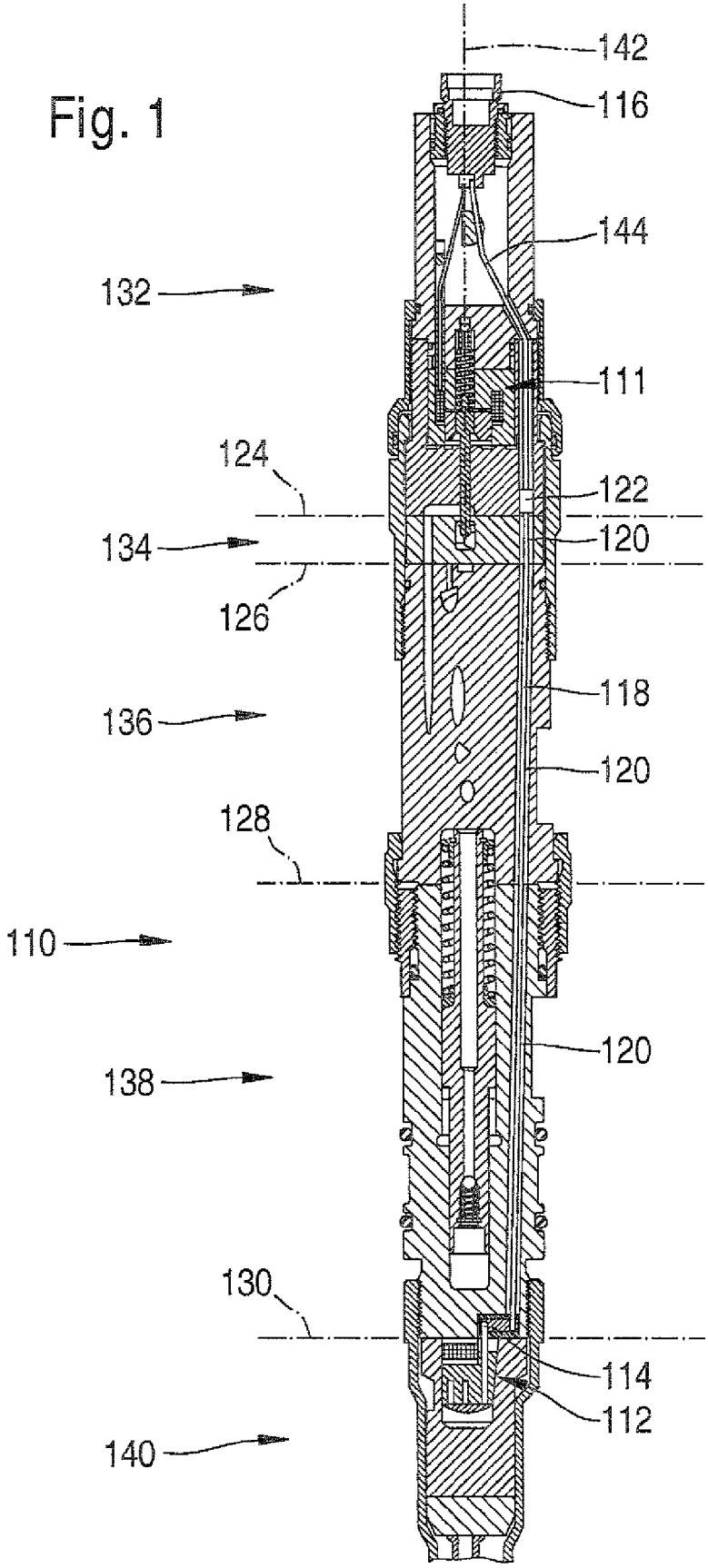
FIG. 1, a sectional view of a fuel injector having a magnet valve for nozzle needle control and a solid conductor for electrical connection of the magnet valve to an external injector body contact.

In FIG. 1, an overall view of an injector body 110 for a common rail injection system is shown. The injector body 110 can be disassembled at the parting lines 124, 126, 128 and 130 into essentially five function modules, namely one control module 132, one sealing plate 134, one line connection module 136, one pressure booster module 138, and one nozzle module 140. The pressure booster module 138 serves essentially to boost a fuel pressure (for instance, 1000 bar), which is made available at the fuel injector from an external pressure source, for instance via a high-pressure collection chamber (common rail) to a second pressure (for instance 2200 bar), so that two operating pressures are available for the injection event.

The injector body 110 furthermore has two magnet valves 111, 112: a first magnet valve 111, disposed in the control module 132, for controlling the pressure boost in the pressure booster module 138, and a second magnet valve 112, disposed in the nozzle module 140, for controlling the actual injection event via an injection valve member (not shown).

The separation between the control module 132 and the rest of the injector body 110 along the first parting line 124 is of considerable practical significance. This separability or disconnectability has the effect that the ("dry") control module 132 and the ("wet") part of the injector body 110 located below the first parting line 124 can be designed, produced and tested separately, and then put together. Moreover, because of this separability, individual components of the injector body 110 can easily be replaced for maintenance purposes, for instance, which is in accordance with the "system repair concept" (SRC).

The magnet valve 112 in the nozzle module 140 is electrically triggerable via two electrical valve contacts 114. The injector body 110, on its upper end, has an electrical injector body contact 116 that is accessible from above. In the modular construction of the injector body 110 as shown, the capability of breaking down the injector body 110 and of simple modular assembly is achieved by providing that the valve contacts 114 be connected electrically to the injector body contact 116 in such a way that simple assembly and capability of breaking down the injector body continue to be assured.

In this exemplary embodiment, for connecting the two electrical valve contacts 114 to the injector body contact 116, two conductor conduits 120 are provided, which extend through the modules 138, 136 and 134. The conductor conduits 120 are formed by bores in the pressure booster module 138, in the line connection module 136, and in the sealing plate 134. Once the injector body 110 has been put together, these bores are each alined at the parting lines 128 and 126, so that the result is a single, continuous conductor conduit 120.

The individual bores of the conductor conduit 120, in this exemplary embodiment, in the various modules 138, 136, 134 each have a rectilinear course. With the provisions of the invention, a curved course of the bores can also be achieved. However, the bores in the individual modules 138, 136, 134 do have a different inclination relative to an injector axis 142. While the conductor conduit 120 in the pressure booster module 138 has an inclination of 1° to the injector axis 142, the inclination in the line connection module 136, in this exemplary embodiment, is 2.2°. These different angles of inclination relative to the injector axis 142 are due to the fact that the injector body 110 tapers in its cross section toward the bottom, that is, from the control module 132 to the nozzle module 140.

The contacting between the valve contacts 114 and the injector body contact 116 should be reliable and not vulnerable to impact in operation, but should be easy to undo again for assembly or maintenance purposes. Also, the connection must be capable without difficulty of following an overall non-straight course of a conductor conduit 120, or in other words must have corresponding flexibility or plasticity.

This problem is solved according to the invention in the exemplary embodiment shown in that the connection between the two electrical valve contacts 114 of the magnet valve 112 and the injector body contact 116 is effected in part via two solid conductors 118. The solid conductors 118 extend through the two conductor conduits 120 and connect the valve contacts 114 to electric plug contacts 122, which in turn are connected to the injector body contact 116 via an electrical connection 144 (for instance, two cables each soldered at one end to an electric plug contact 122 and at another end to the injector body contact 116). The solid conductors 118 are thus fixedly or detachably connected electrically to the valve contacts 114 (see below).

The connection of the solid conductors 118 to the plug contacts 122 is done reversibly, so that this connection can be made upon assembly of the injector body 110 by simply pressing the solid conductors 118 into the plug contacts 122. Conversely, in the event of maintenance, the solid conductors 118 can be easily removed from the plug contacts 122 again, and thus the injector body 110 can be broken down again without having to unsolder electrical connections.

The solid conductors 118 are selected to be rigid enough that on the one hand they do not substantially change their shape under their own weight, and can thus be easily threaded through the conductor conduits 120 with their different inclinations to the injector axis 142 and plugged into the plug contacts 122. The solid conductors should have a certain plasticity, so that no mechanical stresses arise either at the transition between portions of the conductor conduits 120 that have different angles of inclination. The term "solid conductor" does not necessarily narrow the choice of materials to solid materials; on the contrary, hollow conductors (tubes) may for instance also be used as solid conductors 118, as long as they have sufficient mechanical rigidity.

In the exemplary embodiment shown in FIG. 1, the solid conductors 118 may be formed of or contain CuSn6 with a Brinell hardness of between 80 and 90 HB, a material that is otherwise used as a welding additive, for instance. Alternatively, however, CuAl8, CuAl8Ni2, CuAl8Ni6, CuAl9Fe, CuMn13Al7, CuSi3, CuSn, copper, or nickel silver, for instance, can also be used. These materials meet the aforementioned requirements in terms of hardness and plasticity and moreover are easily joined to the valve contacts 114 by welding. The hardness of the materials should be between 50 and 100 HB, preferably between 60 and 95 HB, and especially advantageously between 75 and 90 HB.

Figure 2:
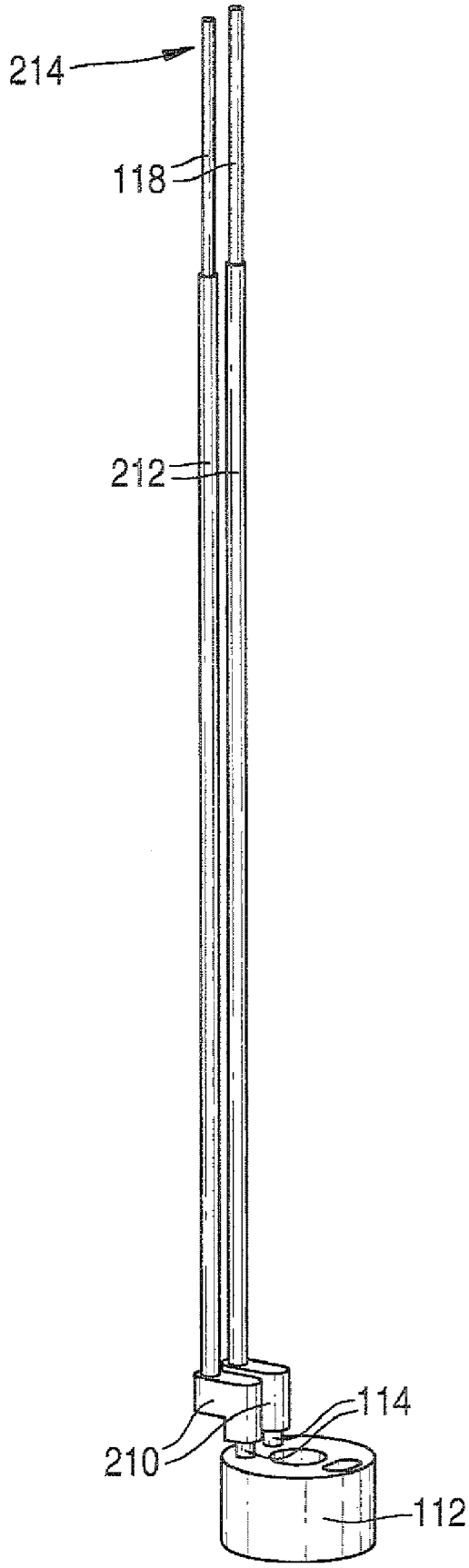
FIG. 2, the magnet valve with its two electrical valve contacts and solid conductors secured to the valve contacts.

In FIG. 2, the magnet valve 112 is shown along with two solid conductors 118, each 127 mm long, which are connected to the valve contacts 114. The connection between the solid conductors 118 and the valve contacts 114 is sheathed in this case with an electrically insulating thermoplastic 210 and is therefore not visible in this perspective view. As the thermoplastic, besides other alternatives, PPS or PA may for instance be used, in particular glass-fiber-filled PPS or PA (such as PPS GF 30 or PA 66 GF 30), and the glass-fiber filling here additionally increases the mechanical stability of the connection. The electrically insulating thermoplastic 210 increases the dimensional stability of the connections between the valve contacts 114 and the solid conductors 118. This additionally assures that the solid conductors 118 will essentially maintain their alignment, which in the assembly of the injector body 110 makes it easier for the solid conductors 118 to be passed through the conductor conduits 120 of the individual modules 138, 136, 134 and then inserted into the plug contacts 122. The thermoplastic 210 also insulates the connecting points from one another, so that short circuits cannot occur between the valve contacts 114. In comparison to conventional flexible wire or cable connections, the assembly of the injector body 110 is thus greatly simplified.

The solid conductors 118 in this exemplary embodiment are also relatively sheathed with shrink-fit hoses 212. The shrink-fit hoses 212 insulate the solid conductors 118 electrically from the walls of the conductor conduits 120 of the injector body 110. To economize on costs, the shrink-fit hoses 212 are not shrunk onto the solid conductors 118 in their entirety, but rather only in some portions. The shrink-fit hoses 212 extend upward from the electrically insulating thermoplastic 210. Alternatively to a shrink-fit hose 212, rigid or elastic electrically insulating plastic sleeves, for instance, can also be used as electric insulators for the solid conductors 118. The electrical insulation, particularly of the shrink-fit hose 212, however, ends in each case below the upper ends 214 of the solid conductors 118, so that the upper ends 214 of the solid conductors 118 are not sheathed in an electrically insulating way and can be plugged in an electrically connecting way into the plug contacts 122. In this way, without a complicated soldering or welding process, by simply putting the segments of the injector body 110 together, an electrically conductive connection between the valve contacts 114 and the injector body contact 116 can be made. On the other hand, the injector body 110 can easily be dismantled again for maintenance purposes, with the plug connection 122 disconnected from the solid conductors 118 again simply by the exertion of force. Unsoldering or disconnecting the connection in some other way is not necessary, since the connection is reversible.

Figure 3:
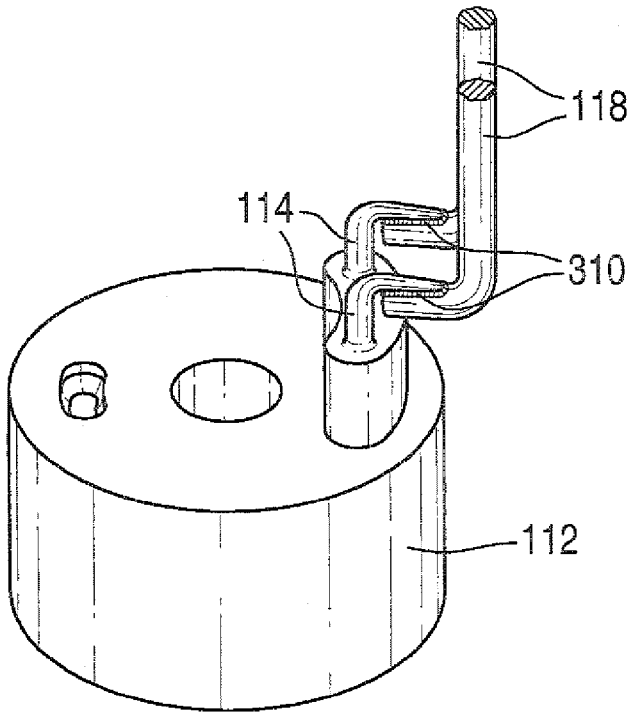
FIG. 3, a fastening of the solid conductor to the valve contacts by welding.

In FIG. 3, one exemplary embodiment of the connections between the valve contacts 114 of the magnet valve 112 and the solid conductors 118 is shown in perspective; the valve contacts 114 and the solid conductors 118 are connected directly by welded connections 310. To this end, the upper ends of the valve contacts 114 are bent over at a right angle, as are the lower ends of the solid conductors 118. The bent-over ends are made to overlap and then are each welded (material-engagement connection). Alternatively, nonpositive-engagement or positive-engagement connections may also be employed. This welded connection 310 makes an economical connection possible between the solid conductors 118 and the valve contacts 114, since no additional connecting elements are necessary. However, in this exemplary embodiment, in the production of the connections the ends must first be bent over and welding is then necessary.

The thermoplastic, electrically insulating plastic sheathing 210 (see FIG. 2) is not shown in FIG. 3 but can also be provided in the exemplary embodiment of FIG. 3, in order to insulate the connection points electrically and to stabilize the connection 310 mechanically.

The exemplary embodiment of FIG. 3 is one example of a direct connection of the valve contacts 114 to the solid conductors 118. Alternatively, the valve contacts 114 can be joined to the solid conductors 118 via electrically conductive connecting elements 410 as well. Examples of such electrically conductive connecting elements 410 are shown in FIGS. 4 through 8. In each case, one end of the electrically conductive connecting element 410 is joined fixedly or detachably to a valve contact 114, and another end of the electrically conductive connecting element 410 is joined to one end of a solid conductor 118. This connection can again be made by positive engagement, nonpositive engagement, or material engagement; care must be taken, however, to assure that the solid conductor 118 should essentially no longer be able to vary its alignment relative to the valve contact 114. This is already been described above in conjunction with FIG. 2 and contributes to the fact that the individual modules 132, 134, 136, 138, 140 of the injector body 110 are simpler to put together.

Figure 4:
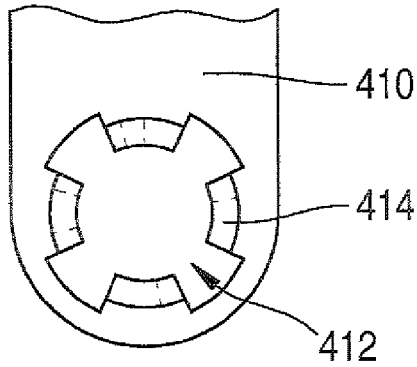
FIG. 4, a positive-engagement connecting element.

In FIG. 4, one possible embodiment is shown of a connection between an electrically conductive connecting element 410 and either one end of a valve contact 114 or one end of a solid conductor 118; the electrically conductive connection is made by means of a positive-engagement connection process. To that end, the electrically conductive connecting element 410 has a bore 412 on one end. The bore 412 of this embodiment has a diameter of 2.5 mm. Protruding into the bore 412 are plastically deformable electrically conductive tongues 414, distributed symmetrically along the circumference of the bore 412. The tongues 414 extend so far into the bore 412 that a clear interior with a diameter of 0.9 mm remains. The tongues 414 are plastically deformable, so that one end of a solid conductor 118 or of a valve contact 114 can be thrust into the bore 412. In the process, the tongues 414 become deformed, in accordance with the insertion direction of the solid conductor 118 or valve contact 114. In the deformation, the tongues 414 form barbs, so that the solid conductor 118 or valve contact 114, once it has first been thrust into the bore 412, can be removed from it again only by exerting greatly increased force. In addition, the tongues 414 act as an electrically conductive connection between the solid conductor 118 or valve contact 114 and the electrically conductive connecting element 410.

Figure 5:
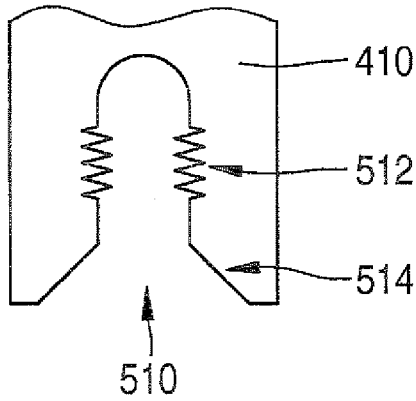
FIG. 5, an alternative positive-engagement connecting element.

In FIG. 5, an alternative embodiment to FIG. 4 of a connection between a connecting element 410 and a solid conductor 118 or valve contact 114 is show. This exemplary embodiment involves a ram contact, in which one end of the solid conductor 118 or valve contact 114 can be introduced, with the exertion of force, into a groove 510 on one end of the electrically conductive connection 410. The groove has one region 512 with plastically deformable sawteeth, as well as a widened insertion region 514 with beveled edges. If one end of the solid conductor 118 or of the valve contact 114 is thrust or rammed into the groove 510 with increased exertion of force, the sawteeth in the region 512 deform plastically. This creates a positive-engagement connection with the end of the solid conductor 118 or of the valve contact 114 that is electrically conductive and mechanically so stable that the solid conductor 118 or valve contact 114 can be removed from the groove 510 again only with increased expenditure of force.

Figure 6:
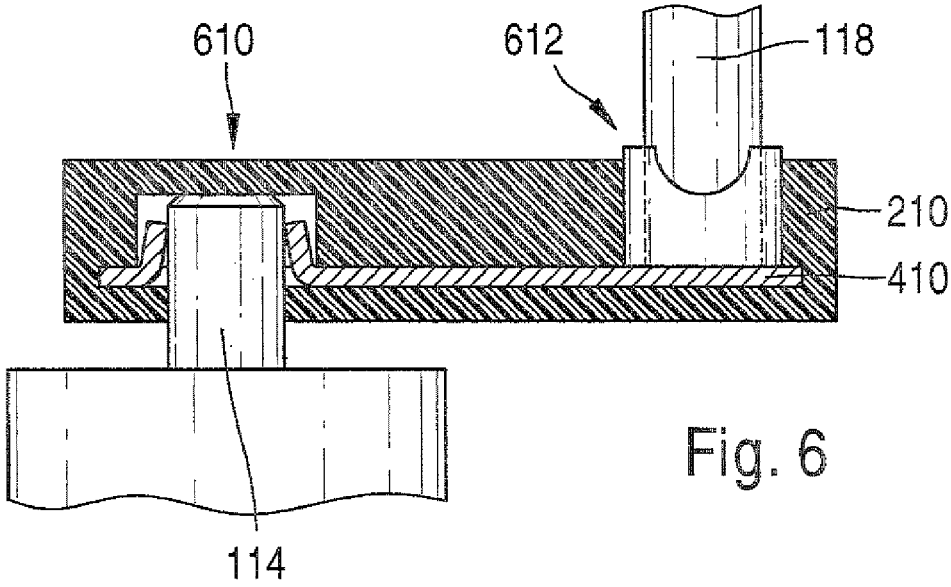
FIG. 6, a sectional view of the connection of a valve contact to a solid conductor via a positive-engagement connection as in FIG. 4 and a plug connection.
Figure 7:
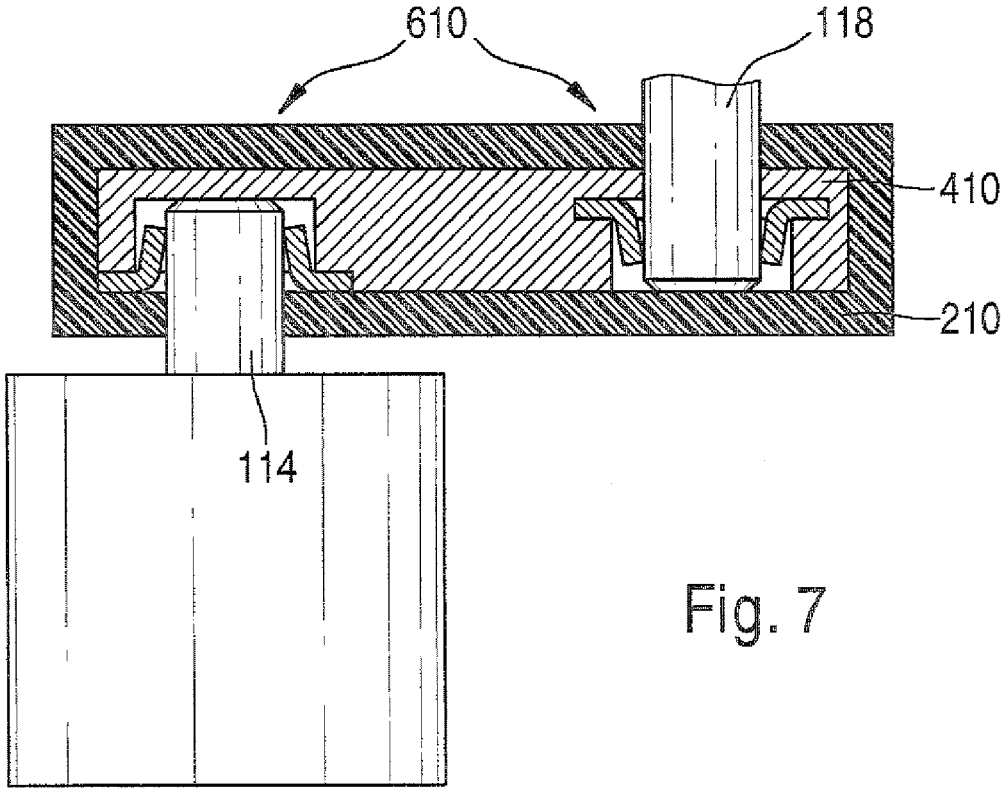
FIG. 7, a sectional view of a connection of a valve contact to a solid conductor via two positive-engagement connections as in FIG. 4.

In FIGS. 6 and 7, possible embodiments of the connection between a valve contact 114 and a solid conductor 118 are shown as examples. The exemplary embodiments show that the possible connections between the solid conductor 118 or valve contact 114 and the electrically conductive connecting element 410 can be combined arbitrarily. For instance, in FIG. 6, one end of a valve contact 114 is joined, by means of a nonpositive-engagement connection 610, as in the exemplary embodiment shown in FIG. 4, electrically conductively to the electrically conductive connecting element 410. On the other end, one end of the solid conductor 118 is also joined conductively to the connecting element 410 via an electrically conductive plug connection 612. This plug connection 612 can be undone again by exertion of force, but the stability of the connection 612 between the solid conductor 118 and the valve contact 114 is assured to such an extent that the solid conductor 118 cannot drop out of the plug connection 612 again by its own weight.

The entire connection between the valve contact 114 and the solid conductor 118 in this exemplary embodiment is also sheathed by an electrically insulating plastic 210. This sheathing, which has already been described above, may be done in particular by an injection molding process.

In FIG. 7, a preferred embodiment that is an alternative to FIG. 6 is shown, in which for connecting the valve contact 114 to the electrically conductive connecting element 410 as well as for connecting one end of a solid conductor 118 to the connecting element 410, positive-engagement connections as in FIG. 4 can be employed. In this exemplary embodiment as well, the entire connection is sheathed by an electrically insulating thermoplastic 210. In contrast to the connection 612 in the exemplary embodiment of FIG. 6, however, after the sheathing, disconnection of the solid conductor 118 from the electrically conductive connecting element 410 is no longer possible without destroying it. The remaining function of the exemplary embodiment of FIG. 7, however, is identical to the mode of operation of the exemplary embodiment of FIG. 6.

Figure 8:
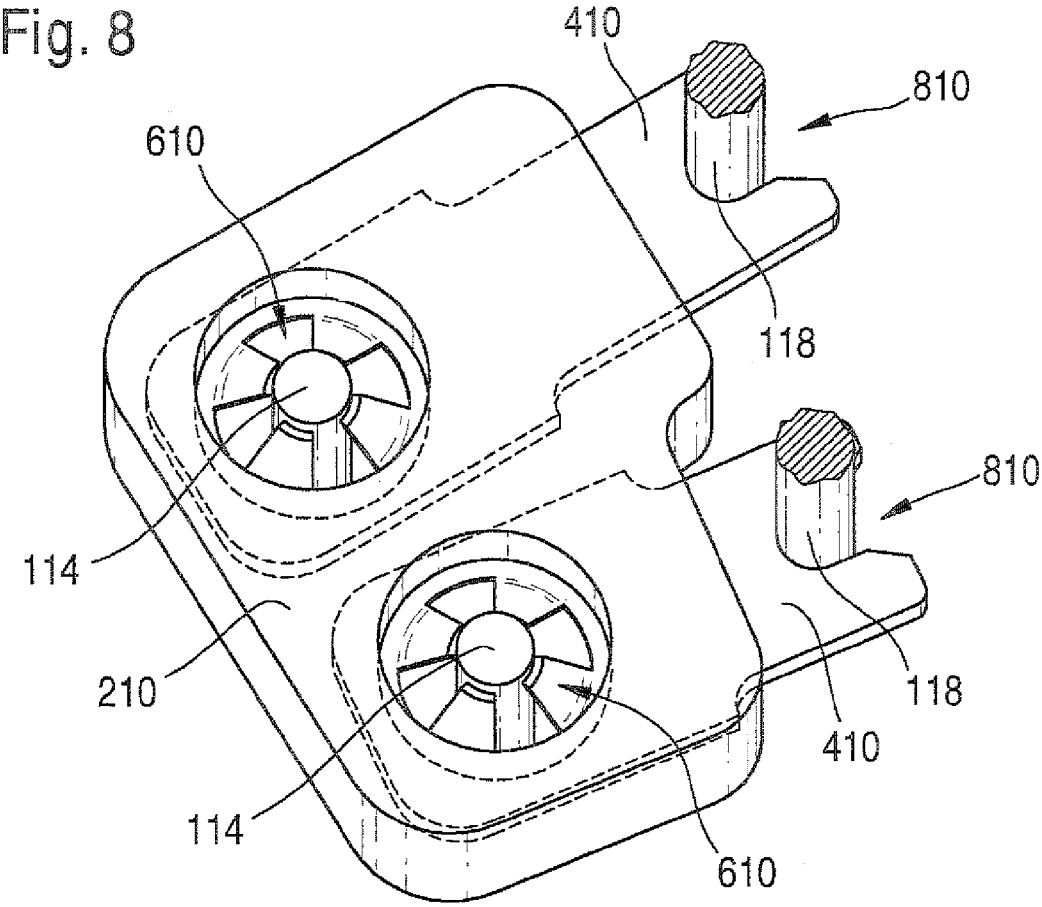
FIG. 8, a perspective view of two connections each between one valve contact and one solid conductor via a respective positive-engagement connection as in FIG. 4 and a positive-engagement connection as in FIG. 5, respectively.

In FIG. 8, a further possible embodiment of the connection between the valve contacts 114 and the solid conductors 118 is shown in perspective. In this exemplary embodiment, the connecting elements 410 each have one positive-engagement connection 610, as in the exemplary embodiment of FIG. 4, on one end. On the other end, the connecting elements 410 have a ram contact 810 as in the exemplary embodiment shown in FIG. 5, by way of which the connecting elements 410 can be joined to the ends of the solid conductors 118. Again in this exemplary embodiment, the entire connection is sheathed by an electrically insulating thermoplastic 210; however, in this exemplary embodiment, all the contacts are joined together by means of a single sheathing 210. The remaining mode of operation of the exemplary embodiment of FIG. 8 is identical to the exemplary embodiments of FIGS. 6 and 7.

Figure 9:
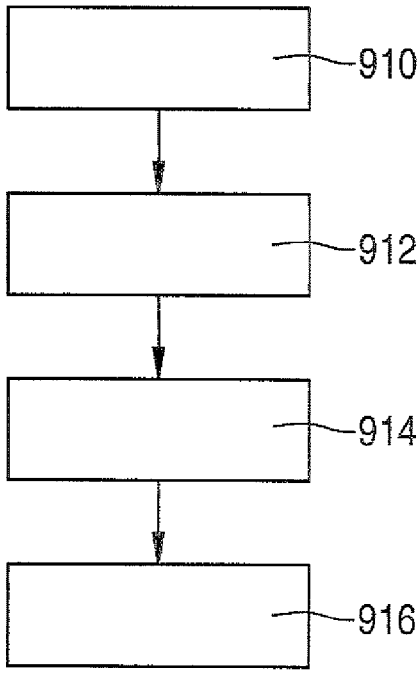
FIG. 9, a flow chart of a method of the invention.

In FIG. 9, a method of the invention for producing a fuel injector is shown. In this method, solid conductors 118 and connections as in the exemplary embodiments shown above, or similar connections according to the invention, are employed. The method steps shown need not necessarily be performed in the order shown. Various method steps may also be performed simultaneously, and additional method steps not shown in FIG. 9 may also be performed.

In a first method step 910, a first module of a fuel injector, such as a control module 132, is produced. This first module has at least one externally accessible injector body contact 116. The injector body contact 116 is electrically conductively joined to an electrical plug contact 122.

In a second method step 912, a second module, such as a nozzle module 140, is produced that has at least one electrically triggerable valve 112. The electrically triggerable valve 112 also has electrical valve contacts 114.

In a third method step 914, the at least one electrical valve contact 114 is joined to at least one solid conductor 118. The solid conductor 118 should have the properties described above. The connection between the solid conductor 118 and the valve contact 114 is made in each case directly or via an electrically conductive connecting element 410 as described above via one of the connections 310, 610, 612, 810 according to the invention.

In a fourth method step 916, the two modules 132, 140 are then connected directly or indirectly to an individual injector body. Additional modules 134, 136, 138 may be introduced as well (see above), and the solid conductors 118 are in particular guided through conductor conduits 120. The at least one solid conductor is reversibly connected directly or indirectly (for instance via plug contacts 122 and an additional electrical connection 144) to the at least one injector body contact 116.

The described method for producing fuel injectors represents a considerable improvement over conventional methods in which electrical cables are used to connect between the valve contacts 114 and the injector body contacts 116. Complicated soldering processes and tedious passing of the cable through the individual segments of the injector body 110 are dispensed with.

The foregoing relates to a preferred exemplary embodiment of the invention, it being understood that other variants and embodiments thereof are possible within the spirit and scope of the invention, the latter being defined by the appended claims.

The invention claimed is:

1. A fuel injector for injecting fuel into a combustion chamber of an internal combustion engine, the fuel injector comprising:

an injector body;

at least one electrically triggerable valve let into the injector body and having at least one electrical valve contact;

at least one electrical injector body contact accessible from an outside of the injector body;

at least one conductor conduit which has a rectilinear course;

at least one solid electrical conductor at least in part connecting the at least one electrical valve contact and the at least one electrical injector body contact, the solid electrical conductor being substantially dimensionally stable under its own weight and extending through the at least one conductor conduit; and an electrically conductive connection joining the at least one solid conductor and the at least one electrical valve contact and/or via at least one electrically conductive connecting element joining the at least one electrically conductive connecting element to the at least one solid conductor and the at least one electrical valve contact via a respective electrically conductive connection each, wherein the electrically conductive connecting element includes a region of plastically deformable electrically conductive tongues or plastically deformable electrically conductive sawteeth, wherein the fuel injector is capable of being disassembled without destruction and assembled from at least two modules, and wherein said at least one electrical injector body contact is disposed on or in a first module, at least one electrically triggerable valve is disposed in a second module that is different from the first module, and wherein the at least one solid conductor is directly or indirectly reversibly and electrically conductively joined to the at least one injector body contact, and further comprising at least one third module having the at least one conductor conduit disposed therein, the third module being disposed substantially entirely between the first module and second module in series along an injector axis of the fuel injector such that the first module is disposed at a first axial end of the injector body and the second module is disposed at a second axial end of the injector body, with all the modules capable of being disassembled from all of the other modules and reassembled without destroying the fuel injector, and wherein the at least one solid conductor extends through the at least one conductor conduit along the rectilinear course, and the conductor conduit has different angles of inclination relative to the injector axis in each different third module of the fuel injector through which the conductor conduit extends.

2. The fuel injector as defined by claim 1, wherein the at least one electrically triggerable valve has a magnet valve.

3. The fuel injector as defined by claim 1, wherein the second module is a nozzle module with an electrically triggerable nozzle valve.

4. The fuel injector as defined by claim 2, wherein the second module is a nozzle module with an electrically triggerable nozzle valve.

5. The fuel injector as defined by claim 1, wherein the at least one solid conductor is electrically insulated from the at least one conductor conduit by means of at least one electrically insulating sheath shrunk onto the at least one solid conductor entirely or in part.

6. The fuel injector as defined by claim 1, further comprising at least one electrically conductive connecting element joining the at least one solid conductor and the at least one electrical valve contact, the at least one electrically conductive connecting element having at least one deformation contact region whereby one end of the at least one solid conductor and/or one end of the at least one valve contact can be thrust into the deformation contact region, whereupon the deformation contact region plastically deforms entirely or in part, making it more difficult to remove the end of the at least one solid conductor or of the at least one valve contact and making an electrically conductive connection between the at least one solid conductor or the at least one valve contact and the at least one connecting element.

7. The fuel injector as defined by claim 1, further comprising at least one connection between the at least one solid conductor and the at least one connecting element, and/or at least one connection between the at least one valve contact and the at least one connecting element, and/or at least one connection between the at least one solid conductor and the at least one valve contact, and/or the at least one connecting element, is sheathed entirely or in part with an electrically insulating plastic.

8. The fuel injector as defined by claim 2, further comprising at least one connection between the at least one solid conductor and the at least one connecting element, and/or at least one connection between the at least one valve contact and the at least one connecting element, and/or at least one connection between the at least one solid conductor and the at least one valve contact, and/or the at least one connecting element, is sheathed entirely or in part with an electrically insulating plastic.

9. The fuel injector as defined by claim 7, wherein the electrically insulating plastic is an injection-moldable plastic.

10. The fuel injector as defined by claim 1, wherein the at least one solid conductor comprises at least one of the materials CuAl8, CuAl8Ni2, CuAl8Ni6, CuAl9Fe, CuMn13Al7, CuSi3, CuSn, copper, or nickel silver.

11. The fuel injector as defined by claim 1, wherein the at least one solid conductor comprises at least one material with a Brinell hardness of between 50 and 100 HB.

12. A method for producing a fuel injector, the method comprising the steps of:

producing a first module of the fuel injector, the first module having at least one electrical injector body contact accessible from an outside of the injector body;

producing a second module the second module having at least one electrically triggerable valve with at least one electrical valve contact;

connecting the at least one electrical valve contact to at least one electrical solid conductor which is essentially dimensionally stable under its own weight, via an electrically conductive connection and/or via at least one electrically conductive connecting element, the at least one connecting element being connected to the at least one solid conductor and to the at least one electrical valve contact via a respective electrically triggerable valve, wherein the electrically conductive connecting element includes a region of plastically deformable electrically conductive tongues or plastically deformable electrically conductive sawteeth;

connecting the first module and the second module directly or indirectly to an injector body;

reversibly connecting the at least one solid conductor directly or indirectly to the at least one electrical injector body contact;

producing at least one third module which has at least one solid conductor conduit having a rectilinear course disposed therein and connecting the third module between the first and second modules such that the third module lies substantially entirely between the first and second modules in series along an injector axis of the fuel injector and such that the first module is disposed at a first axial end of the injector body and the second module is disposed at a second axial end of the injector body, with all the modules capable of being disassembled from all of the other modules and reassembled without destroying the fuel injector; and wherein the at least one solid conductor extends through the at least one conductor conduit along the rectilinear course, and the conductor conduit has different angles of inclination relative to the injector axis in each different third module of the fuel injector through which the conductor conduit extends.

* * * * *